United States Patent [19]

Schnitzler

[11] Patent Number: 4,945,583

[45] Date of Patent: Aug. 7, 1990

[54] DEVICE FOR TRANSPORTING DISABLED OR SICK PERSONS

[76] Inventor: Alois Schnitzler, Hummerichs Bitze 9, D-5300 Bonn 3, Fed. Rep. of Germany

[21] Appl. No.: 168,654

[22] Filed: Mar. 16, 1988

[30] Foreign Application Priority Data

Mar. 17, 1987 [DE] Fed. Rep. of Germany ..... 3708680

[51] Int. Cl.[5] ..... A61G 1/00

[52] U.S. Cl. ..... 5/82 R; 5/81 R

[58] Field of Search ..... 5/82 R, 424, 81 R; 128/869, 870

[56] References Cited

U.S. PATENT DOCUMENTS

| | | | |
|---|---|---|---|
| Re. 28,916 | 7/1976 | Rice et al. | 5/462 X |
| 4,064,574 | 12/1977 | Schnitzler | 5/82 R |
| 4,115,884 | 9/1978 | Keogh | 5/82 R |
| 4,151,842 | 5/1979 | Miller | 5/82 B X |
| 4,234,982 | 11/1980 | Bez et al. | 5/82 R X |
| 4,252,113 | 2/1981 | Scire | 5/82 R X |
| 4,254,518 | 3/1981 | Buhren | 5/424 X |
| 4,485,504 | 12/1984 | Lehmann | 5/82 R |
| 4,534,075 | 8/1985 | Schnitzler | 5/82 R |
| 4,569,095 | 2/1986 | Holling | 5/82 R |
| 4,627,428 | 12/1986 | Brooks | 5/82 R X |

FOREIGN PATENT DOCUMENTS

| | | | |
|---|---|---|---|
| 477801 | 5/1975 | Australia | 5/82 R |
| 2318964 | 10/1974 | Fed. Rep. of Germany | 5/82 R |

*Primary Examiner*—Alexander Grosz
*Assistant Examiner*—Michael J. Milano
*Attorney, Agent, or Firm*—Bean, Kauffman & Spencer

[57] ABSTRACT

A device for transporting disabled or sick persons comprises a stretcher mattress attachable to a stretcher frame or a transport vehicle by means of a belt band emerging from the underside of the foot end of said mattress. Belt bands which issue at the head end of the upper side of said mattress in the vicinity of its central longitudinal axis and interact with additional belt bands projecting laterally in the middle area from the edge of said mattress result in secure support of the disabled or sick person during transport on his back or side and allow the attending physician unimpeded access to the subject's thorax. Bracings located beneath said mattress and connected to one another by means of hinges allow the subject to be transported in close quarters. There are furthermore provided wedge-shaped cushions forming a bolstered edge portion, under which cushions a sheet to be placed on said mattress can be inserted without removing the belts.

39 Claims, 9 Drawing Sheets

DEVICE FOR TRANSPORTING DISABLED OR SICK PERSONS

TECHNICAL FIELD

The invention relates to a device for transporting disabled or sick persons, and more particularly to a stretcher mattress for use on a carrier.

DESCRIPTION OF THE BACKGROUND ART

Prior devices for transporting disabled or sick persons were problematic in that persons who had to be transported lying down could not be adequately secured, as conventional belts extending transversely across the stretcher or litter could not be relied upon to prevent the subject from continuing to move in a forward direction in the event of an accident. Since subjects are as a rule transported with their heads in the direction of movement, efforts were made to solve this problem by means of a head cushion fixed to the head end of a stretcher and/or mattress provided thereupon, with the subject's head and shoulder area to rest against said cushion. However, this solution likewise fails to provide sufficient safety and can possibly lead to a compression of the subject's spinal column. Furthermore, when a pillow of this kind is used, the subject can be transported only in a supine position, not on his side, as is sometimes necessary. Efforts have also been made to solve the above problem by means of complex suspender belt systems. Here again, however, it is impossible to transport the subject safely on his side. Moreover, the belt system is difficult to arrange, gets tangled easily, and, when fastened, impedes the attending physician in his efforts to gain access to the thorax of the subject, thus preventing the subject from receiving optimal care and treatment.

OBJECTS AND SUMMARY OF THE INVENTION

It is an object of the invention to provide a stretcher mattress which allows easy transport of a disabled or sick person in close quarters. It is a further object of the invention to provide a stretcher mattress which allows the subject to be supported securely on his back or side and furthermore offers improved access for the attending physician and a higher degree of user comfort. It is a further object of the invention to provide a stretcher mattress which allows sheets to be changed easily. It is a further object of the invention to provide a device for transporting disabled or sick persons which allows easy transport of a disabled or sick person in close quarters. It is a further object of the invention to provide a device for transporting disabled or sick persons which allows the subject to be supported securely on his back or side and furthermore offers improved access for the attending physician and a higher degree of user comfort. It is a further object of the invention to provide a device for transporting disabled or sick persons which allows sheets to be changed easily.

The aforementioned and further objects are established by the invention. According to a first aspect, the invention relates to a stretcher mattress having an essentially planar upper side for supporting a disabled or sick person and an underside serving as a support on a carrier, with two belt bands issuing from the head end of the upper side of the mattress, the free end of each of said belt bands being connectable to one of the free ends of two additional belt bands, one of said additional belt bands projecting from the left lateral edge area and one from the right lateral edge area of said mattress at locations which are shifted, relative to the point of origin of the corresponding first belt band from the upper side of the mattress, along the central longitudinal axis towards the middle of said mattress.

According to a second aspect, the invention relates to a stretcher mattress having an essentially planar upper side for supporting a disabled or sick person and an underside to be supported on a carrier, with two belt bands issuing from the head end of the upper side of the mattress, the free end of each of said belt bands being connectable to one of the free ends of two additional belt bands, one of said additional belt bands projecting from the left lateral edge and one from the right lateral edge area of said mattress at locations which are shifted, relative to the point of origin of the corresponding first belt band from the upper side of the mattress, along the central longitudinal axis towards the middle of said mattress, said mattress being provided with an upwardly projecting bolstered edge portion extending longitudinally on both sides of its upper side.

According to a third aspect, the invention relates to a stretcher mattress with an essentially planar upper side for supporting a disabled or sick person and with an underside to be supported on a carrier, said mattress having upwardly projecting bolstered edge portions disposed laterally on each side of its upper side, each of said bolstered edge portions being formed of a cushion whose cross-section is essentially outwardly ascending and wedge-shaped, said cushions being connected to said mattress only in the vicinity of their pointed edge disposed away from the outermost edge of said mattress.

According to a fourth aspect, the invention relates to a device for transporting disabled or sick persons, comprising a stretcher mattress with an essentially planar upper side for supporting a disabled or sick person and an underside to be supported on a carrier, with two belt bands issuing from the head area of the upper side of the mattress in the vicinity of the central longitudinal axis of same, the free end of each of said belt bands being connectable to one of the free ends of two additional belt bands, one of said additional belt bands projecting from the left lateral edge area and one from the right lateral edge area of said mattress at locations which are shifted, relative to the point of origin of the corresponding first belt band from the upper side of the mattress, along the central longitudinal axis towards the middle of said mattress.

According to a fifth aspect, the invention relates to a stretcher mattress which is flexible and at the same time possesses an inherent elastic rigidity, said mattress being provided with an upwardly projecting bolstered edge portion extending longitudinally on both sides of its upper side and having take-up means for belt means of a belt system for securing a disabled or sick person on said mattress, the take-up device being arranged in said mattress below said bolstered edge portions. The stretcher mattress has upwardly projecting bolstered edge portions disposed laterally on each side of its upper side, each of said bolstered edge portions comprising a cushion whose cross-section is essentially outwardly ascending and wedge-shaped, said cushions being connected to said mattress only in the vicinity of their pointed edge disposed away from the outermost edge of said mattress. Said stretcher mattress has take-up means arranged below said cushions, said take-up means being of an automatically arresting type. Said stretcher mattress has a belt system comprising a first pair of belts for securing the legs and a second pair of belts for securing the thorax of a disabled or sick person on said mattress.

When use is made of the device in an ambulance, the subject is to be transported with his head in the direction of movement of the vehicle, if possible. The subject himself will be bothered as little as possible by the belt system extending along the underside of the mattress, which is for the most part not visible, and his freedom of movement will remain as unrestricted as possible.

For the purposes of this application, the designation "head end" of the mattress is understood to refer to the portion of the mattress extending from the front face of the same and along approximately 25% of the entire length of the mattress towards its interior. This area is designated as I in FIG. 2. According, the designation "foot end" is understood to refer to the portion of the mattress extending from the face at the foot and along approximately 25% of the length towards the middle of the mattress, said area being designated as II in FIG. 2. The portion between these two ends of the mattress is referred to as the "middle area", with the area on the side of the central transverse plane B—B disposed towards the head end being designated as III and the area on the side disposed towards the foot end being designated as IV in FIG. 2.

A stretcher frame or any supporting surface suitable for this purpose in a transport vehicle of any kind can serve as a "carrier".

To secure the disabled or sick person during transport, one of the first belt bands issuing from the upper side of the mattress in the vicinity of the subject's neck is guided over each of his shoulders and connected to the free end of the additional belt band located on the corresponding side. The subject is thereby well secured during transport, while his entire thorax region is at the disposal of the attending physician, who may wish to place electrodes or stethescopes there or to perform artificial respiration. By omitting one of the belt bands, it is also possible to secure a subject lying on his side. Likewise, it is possible simply to use the two other belt bands issuing laterally from under or along the mattress, this being particularly simple if these additional belt bands can be drawn off a take-up mechanism against the resistance of a spring. Self-arresting take-up mechanisms as used in automatic safety belts, which arrest the belt drum in the event of sudden acceleration, are particularly suited for this purpose; firstly, since the subject normally still enjoys sufficient freedom of movement, and secondly, since the desired support is guaranteed when necessary. As a rule, the above-described belt systems are used together with supporting belts attached to the stretcher frame or possibly also to the mattress and extending transversely across the subject from one side of this carrier to the other. However, since this kind of belt system is sufficiently well known, it will not be described in greater detail in the application.

Preferred improvements of the belt system, in particular as regards the arrangement and dimensioning of the individual belts, are specified in subclaims 5 to 9. The first belt bands, which are in the vicinity of the subject's neck and issue from the surface of the mattress or are fixed there, are particularly well positioned if they issue in the vicinity of the central longitudinal axis (L—L). The free ends of the belt bands interacting to secure the subject may be releasably bound to each other as desired. It is particularly appropriate to provide for this purpose conventional belt locks at one end of the belt band and corresponding lock plates at the end of the other belt band interacting with it, such as the lock systems known as safety belts in motor vehicles and aircraft, and to design all systems of this kind in the entire transport device identically. This allows the above-mentioned simple combination of various possible uses, as well as the following others. It is conceivable that the disabled or sick person must be transported directly on the stretcher mattress under circumstances in which it is, for reasons of space, impossible or impractical to use a stretcher frame, for example, on a staircase or on rugged terrain. In this case the subject on the mattress is secured by means of the laterally projecting additional belt bands, while the free ends of the belt bands issuing from the upper side beneath the subject's neck, when connected to each other, can serve as an additional supporting belt. Said belt is, however, not to encompass the subject's head area, if this can be avoided. Due to the elasticity of the mattress material, transport ensues in a somewhat bent position in any case, since the mattress bends in the vicinity of the subject's center of gravity—the pelvic or abdominal area. This can be compensated for by using material of appropriate rigidity for the mattress.

The first belt bands can be connected directly to the mattress material if it is sufficiently hard. According to a preferred embodiment, however, the first belt bands are connected to at least one additional belt band extending beneath the surface of the mattress towards the foot end of same in an essentially longitudinal direction, said belt band either holding directly or being connected to the fixing means in the foot portion of the mattress. In the event of an accident, the force acting on the belts is thus transferred directly to the fixing means and taken up there before substantial deformation of the mattress occurs. In a first, simple embodiment, the belt band is located on the underside of the mattress, it also being appropriate to sew the belt to the mattress along its entire length such that transport is not impeded. However, it has been found preferable to locate this additional belt band inside the mattress such that its free end issues at the foot area of same, either on the face of the mattress or on its underside, the latter arrangement being particularly advantageous for use on stretchers.

The first belt bands are fastened to the opposite end of the additional belt band disposed towards the head of the mattress, for example, by means of a mixture element in the shape of a triangular ring or a fixture plate provided with corresponding slots. The design can be further simplified by leading the end of the additional belt band disposed towards the head of the mattress out through the upper side of the mattress such that it forms one of the first two belt bands, with the other first belt band being fastened to it before it emerges, said belts preferably being sewn or riveted together. This also ensures that no hard elements which could impair the comfort of the subject are located in the actual area of support of the mattress.

It has also been found particularly appropriate to make use of belt lock arrangements as a releasable means of attaching the mattress to the stretcher frame and/or the transport vehicle, the belt lock itself and/or the lock plate operatively connected thereto being fixed to appropriate areas of the mattress, for example, to the additional belt band or to the stretcher frame or transport vehicle. If attachment is made on a stretcher frame, it has been found particularly appropriate to locate the point of attachment on a belt system which can be placed around the longitudinal rail of the stretcher frame, said belt system also being quickly attachable to any stretcher frame by means of a belt lock, irrespective of whether said frame was originally intended for uses with the stretcher mattress. The multiplicity of uses for the subject matter of the invention is hereby further extended.

The invention is not restricted to providing the belt system explained above in detail solely at the head end and the portion of the middle area of the stretcher adjacent thereto; rather, it is also possible to attach a similar arrangement to the foot end and the portion of the middle area adjacent thereto. This embodiment has the advantage that it is not necessary to spend a great deal of time making certain the stretcher mattress is properly aligned with respect to the disabled or sick person before placing him on it, thereby saving additional time in emergency situations where seconds may be crucial. This arrangement also results in additional initial security for the subject and those carrying him on the mattress to the stretcher frame or a transport vehicle. It has been found favorable to design the mattress, as far as the belt systems and/or fixture means are concerned, symmetrical to the central transverse plane B—B. Furthermore, for the two belt bands issuing form the upper side at both the head and foot ends, only one pair of additional belt bands can be provided in the vicinity of the central transverse plane. This pair of belt bands, together with the pair of first belt bands then at the subject's head, assume the support of the subject, while one of the two belt bands then issuing at the foot end of the upper side of the mattress can be employed as a holding means, as indicated by dotted line in FIG. 5. However, these two belt bands can also be used as a holding means in an appropriate embodiment.

If the additional belt bands are fastened to the mattress such that they issue laterally from the mattress or from beneath it, it is advisable to connect these belt bands to the additional belt band having the fixing means on its free end by means of belt bracing elements in such a way that a force acting on the second belt band in the direction of movement is directed to and taken up by the fixing means.

It is appropriate to manufacture the mattress of a material such that the end product is flexible yet possesses an inherent elastic rigidity, i.e., it can be deformed when it meets with resistance, such that it can be rolled up for easy carrying, for example, while at the same time being so rigid in itself that it provides adequate support for a disabled or sick person during transport on narrow staircases or on impassable, rugged terrain. Such support is essential for careful transport, for example, in order to avoid further dislocation of broken bones. The placement of carrier loops on the mattress is also conducive to this use, as well as the provision of bolstered edge portions projecting upwardly on both sides, since these bolstered edge portion increase rigidity in the longitudinal direction and prevent the subject from rolling off the mattress unintentionally. These bolstered edge portions can also serve to receive the take-up device for the additional belt bands.

Finally, it has also been found favorable to provide the mattress, particularly in the area from which the additional belt bands project laterally, with a transverse bracing preferably extending across its entire width. Said bracing may, for example, comprise a board or synthetic plate on which the take-up devices can also be mounted.

In a further advantageous embodiment of the invention, a bracing is located on the underside of the mattress, said bracing consisting of two reinforcing elements which are arranged to be hinged about an axis located at a distance of approximately one third to one half of the mattress length from the head end of the mattress. Carrier handles are also located at both ends of the mattress. The reinforcing elements can be wooden plates attached to the mattress in an appropriate fashion or a tubular frame.

It is appropriate to provide a fixing device for fixing the relative position of the two reinforcing elements, said fixing device preferably being a telescopic bar linkage. The telescopic bars of said linkage, which fit into each other, are each joined by a hinge to one of the reinforcing elements and can be set in their adjustable position relative to one another by means of a locking device. It is advantageous to locate the points of support for the telescopic bar linkage on a shackle projecting upwardly from the reinforcing elements, in order to obtain a favorable application of force for the telescopic bars and to have said bars located in the vicinity of the upper edge of the mattress when in their position of rest. In this position the telescopic bars and the belt ends attached to the mattress do not interfere with one another.

By virtue of the above arrangement, the mattress can be transformed into a partially folding carrier chair by means of which a disabled or sick person can be transported even on narrow staircases or in angular corridors without the middle portion of the bent mattress sagging in such a way as to cause the subject discomfort.

It is appropriate to provide a fixing device for fixing the relative position of the two reinforcing elements, said fixing device preferably being a telescopic bar linkage. The telescopic bars of said linkage, which fit into each other, are each joined by a hinge to one of the reinforcing elements and can be set in their adjustable position relative to one another by means of a locking device. It is advantageous to locate the points of support for the telescopic bar linkage on a shackle projecting upwardly from the reinforcing elements, in order to obtain a favorable application of force for the telescopic bars and to have said bars located in the vicinity of the upper edge of the mattress when in their position of rest. In this position the telescopic bars and the belt ends attached to the mattress do not interfere with one another.

By virtue of the above arrangement, the mattress can be transformed into a partially folding carrier chair by means of which a disabled or sick person can be transported even on narrow staircases or in angular corridors without the middle portion of the bent mattress sagging in such a way as to cause the subject discomfort.

If, according to further advantageous features of the invention, a hook is provided on a bracing located beneath the mattress, said hook being open in the direction of movement of the ambulance when the mattress is in transport position and engaging in this transport position with an element of the stretcher frame or transport vehicle extending transversely to the direction of movement, for example, with a bracing extending transversely to the direction of movement, connection with the belt system of the mattress is established automatically when the mattress is brought into transport position. It is thus impossible, even in the excitement typical of accident scenes, to forget to secure the subject properly against sliding in the event that the transport vehicle must brake sharply.

It is furthermore appropriate to join the bracing supporting the hook with a portion of the safety belt system, for example, with a belt band extending beneath the mattress in the longitudinal direction of the same. It is moreover advantageous to attach at least one of the take-up devices for the belt bands of the safety belt system or additional belt bands on the bracing provided beneath the mattress. The take-up device is preferably attached above the bracing and projects into a corresponding recess of the mattress.

Finally, according to a further advantageous feature of the invention, the mattress is provided with bolstered edge portions projecting upwardly on both sides of its upper side. These bolstered edge portions are formed by an essentially wedge-shaped cushion attached to the mattress only in the vicinity of the pointed edge of the cushion disposed away from the outermost edge of the mattress. It is thus possible to wrap a sheet to be placed on the mattress around said mattress without loosening the belt portions extending around the lower edge or fastened to the side wall of the mattress. In this case the sheet is simply placed around the cushion forming the bolstered edge portion and held in place between the cushion and the mattress. Since it is often necessary to change sheets several times a day on devices for transporting disabled or sick persons, this last arrangement signifies a considerable reduction of work.

A BRIEF DESCRIPTION OF THE DRAWINGS

In the following the present invention will be explained in more detail with reference to the accompanying drawings.

PREFERRED EMBODIMENTS OF THE INVENTION

Figure 1:
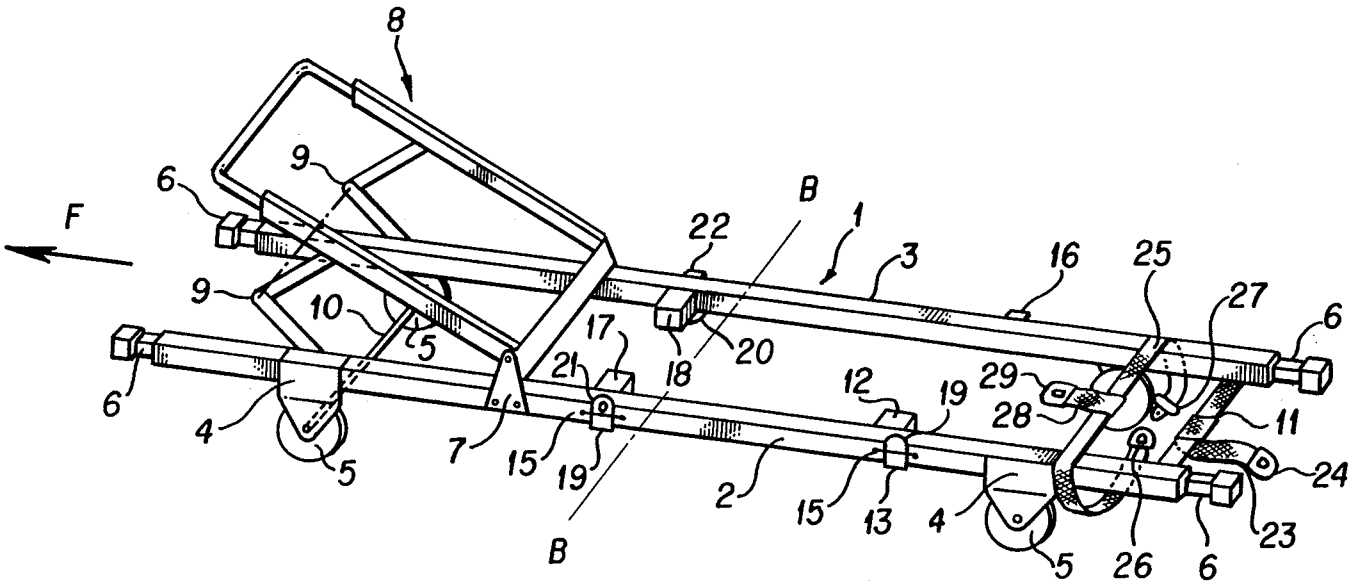
FIG. 1 is a stretcher frame for receiving a stretcher mattress, said frame being provided with wheels, with this view representing, firstly, the possibility of attaching additional belts to the stretcher frame, and secondly, two variants of arresting the mattress relative to the stretcher frame.

FIG. 1 is a simplified perspective representation of a stretcher frame 1 consisting of two longitudinal rails 2 and 3 comprising fixtures 4 for wheels 5 as well as a pull-out carrier handle 6 on each of its ends. A U-shaped seat back 8 is pivotally linked by means of a hinge plates 7 to the end of the stretcher frame 1 disposed in the direction of movement F, said seat back being supported by hinged adjustment plates 9 and arrestable at various heights. The wheels 5 are connected to one another by means of an axle 10. At the foot end of the stretcher frame 1 there is also located a cross-strut 11, which rigidly connects the longitudinal rails 2 and 3 to one another at the desired distance. A belt take-up mechanism 12 is located on the inside of longitudinal rail 2. From said mechanism a free belt portion 13 is led beneath longitudinal rail 2 to end into a lock plate 14 held on the upper side of a U-shaped guide element 15. Belt band 13 is freely adjustable between guide element 15 and longitudinal rail 2. By pulling on the lock plate 14 it is possible to draw belt band 13 so far from the belt take-up drum that the belt band can be extended across a mattress (not shown in FIG. 1) located on stretcher frame 1 and the legs of a disabled or sick person lying on said mattress. Said lock plate can then be inserted into a lock 16 attached to the outside of longitudinal rail 3. Between hinge plate 7 for linking seat back 8 and the central transverse plane B—B of the stretcher frame, two further belt take-up mechanisms 17 and 18 are located on the inside of longitudinal rails 2 and 3 such that their upper edges are flush with the upper edges of longitudinal rails 2 and 3. Belt bands can be drawn off of the belt take-up mechanisms 17 and 18, to whose free ends 19 and 20 a lock 21 and lock plate 22, respectively, are loosely attached. Guide elements 15 prevents lock 21 and lock plate 22 from being pulled under the stretcher frame 1 when belt bands 19 and 20 are pulled.

Two variants for attaching a stretcher mattress are shown at the foot end of stretcher frame 1. The first of these consists of a belt portion 23 attached to cross-strut 11 and having at its end a lock 24 which interacts with a lock plate in a manner to be explained in greater detail in the following, said lock plate being attached to a belt portion hanging down from the underside of the mattress. The second variant consists of a belt band 25 having on its free ends a lock 26 and a lock plate 27 which allow belt band 25 to be placed around longitudinal rails 2 and 3 as shown and fastened by fitting the lock and lock plate together. A belt portion 28 is sewn to the middle of belt portion 25 and projects perpendicularly therefrom, the former having a lock 29 on its free end.

While the stretcher mattress 30 shown in FIGS. 2–5 can be placed on stretcher frame 1, it can accordingly also be attached directly to a carrier in an ambulance without a stretcher frame of this kind, as described in connection with stretcher frame 1.

The mattress 30 has an essentially planar upper side 31 and an underside 32. It is shown comfortably padded, resulting in a certain thickness d, which can be varied as desired to meet requirements. Each side of the mattress 30 is provided with a bolstered edge portion 33, 34 rising in a wedge shape to the outer sides of the mattress 35, 36. The face disposed towards the head end is designated 37, that towards the foot end, 38. The mattress is tapered at its head end by means of two obliquely extending areas. It also has carrier loops 39 at its front and back ends.

In the area of the central longitudinal axis L—L at the head end I of the mattress 30, there is formed an opening with reinforced edges in the upper side 31, from which a first pair of belt bands 41 and 42 issue, with belt band 41 having a lock 43 on its end and belt band 42 having a lock plate 44 on its free end. Opening 40 should not be spaced more than one-fourth the entire length of the mattress from head end 37; is usually spaced a distance of 10%–20% of the length of the mattress and preferably a distance of approximately 15% of the length of the mattress. Belt band 42 merges into a third belt band 45 inside of the mattress or is attached to said belt inside the mattress 30 and adjacent to the opening, as shown for the inner end 46 of belt band 41. Belt band 45 runs inside mattress 30, following the longitudinal center axis L—L straight through the middle of mattress 30. The free end of said belt band issues from mattress 30 at its foot end through an opening 47 on the underside 32. Said free end bears the reference number 48 and has a lock plate 49, which can be inserted into lock 24 or lock 29 of FIG. 1, thus establishing a secure connection to stretcher frame 1.

Figure 3:
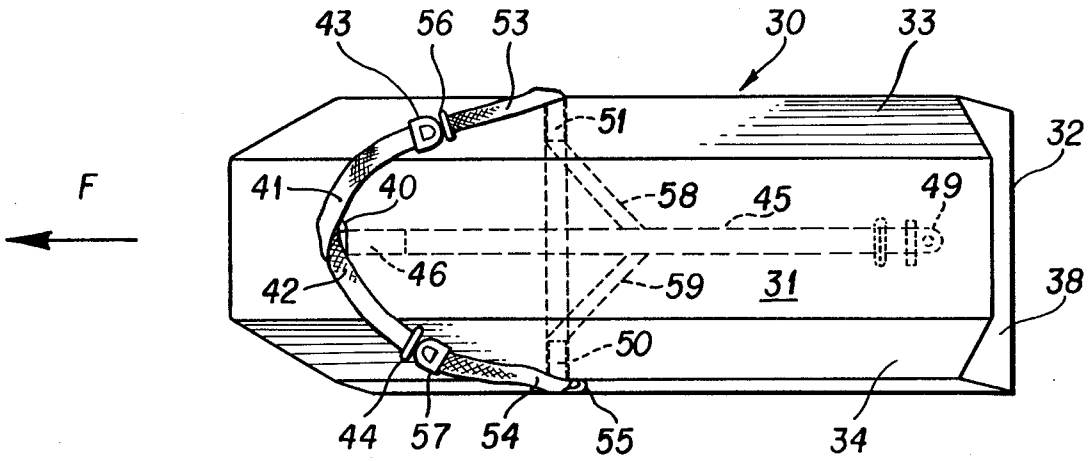
FIG. 3 is a top plan view similar to that of FIG. 2 but in which the belt bands are connected to one another in a first embodiment.
Figure 4:
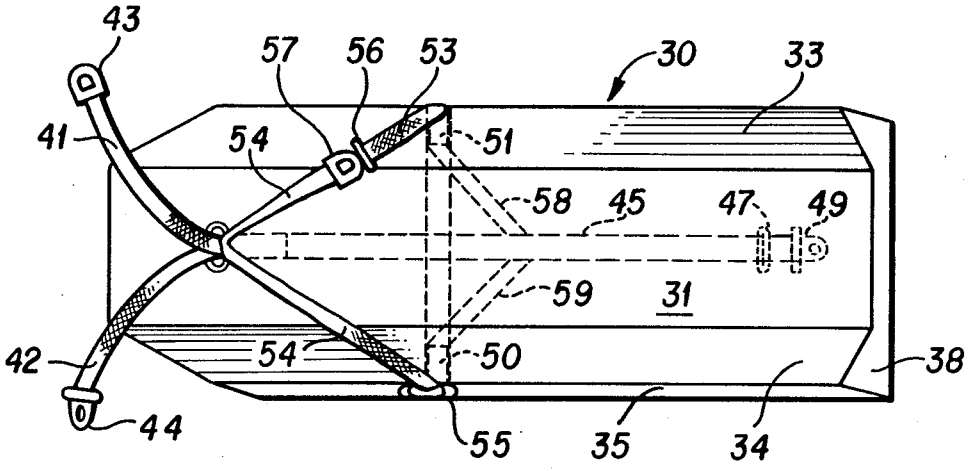
FIG. 4 is a view similar to that of FIG. 2 but in which the belt ends are connected differently than in FIG. 3.

The mattress 30, when provided with a belt system consisting of belt bands 41, 42, and 45, can be placed on stretcher frame 1 and attached thereto as described above without the further elements shown in FIG. 2 being necessary. The disabled or sick person can then be secured accordingly, as shown in FIG. 3 and FIG. 4, by employing belt bands 19, 20 and 41, 42. In the one case, lock plate 44 is inserted into lock 21 and lock plates 22 into lock 43. In the event that the subject is resisting on his side, lock plate 22 is inserted into lock 21 after belt bands 19, 20 have been looped over one of the subject's shoulders to encompass his thorax.

Figure 2:
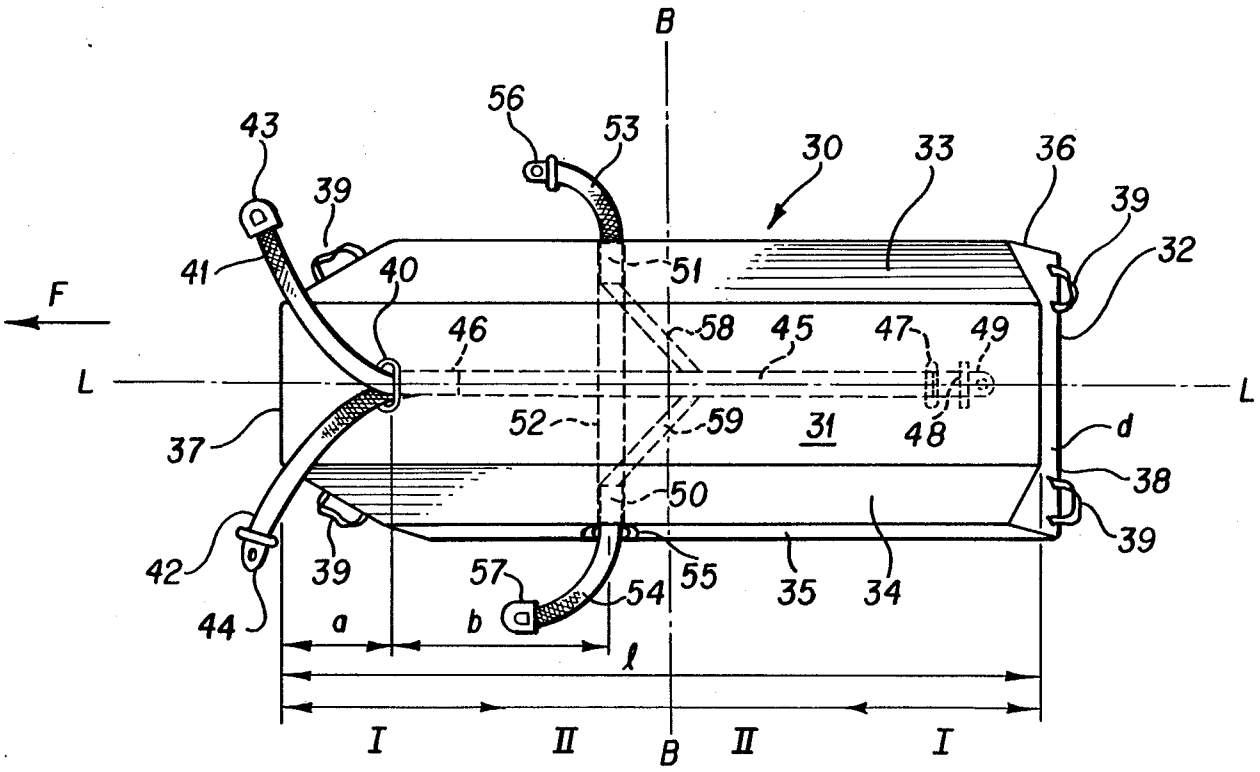
FIG. 2 is a top plan view of a first embodiment of a stretcher mattress as it can be employed with the stretcher frame of FIG. 1, wherein the individual belt bands are loose.

For the special embodiment shown in FIG. 2, however, it is not necessary to locate belt take-up mechanisms 17 and 18 on stretcher frame 1, since mattress 30 itself is provided with belt take-up mechanisms 50 and 51 mounted in the vicinity of the bolstered edge portions 33, 34 on a board-like transverse bracing 52 extending on the underside of the mattress from lateral face 35 to lateral face 36 such that the free ends of an additional or a second pair of belt bands 53, 54 issue from reinforced openings 55 in the outside of mattress 30. Belt band 53 bears a lock plate 56 on its free end, belt band 54, a lock 57. The belt take-up mechanisms 50, 51 are furthermore attached to belt band 45 via connecting belts 58, 59 extending diagonally in the direction of the free end 48 of belt band 45 such that a force acting on the take-up mechanisms 50, 51 in direction F is transferred to belt band 45 and from there via lock plate 49 to lock 24 or 29 and thus to stretcher frame 1 or the carrier in the transport vehicle.

FIG. 3 shows stretcher mattress 30 in the operational condition in which a person in a supine position is secured, with lock plate 44 inserted into lock 57 and lock plate 56 into lock 43.

FIG. 4 shows the other possibility, in which lock plate 56 is inserted into lock 57 and bands 41 and 42 remain unattached.

Figure 5:
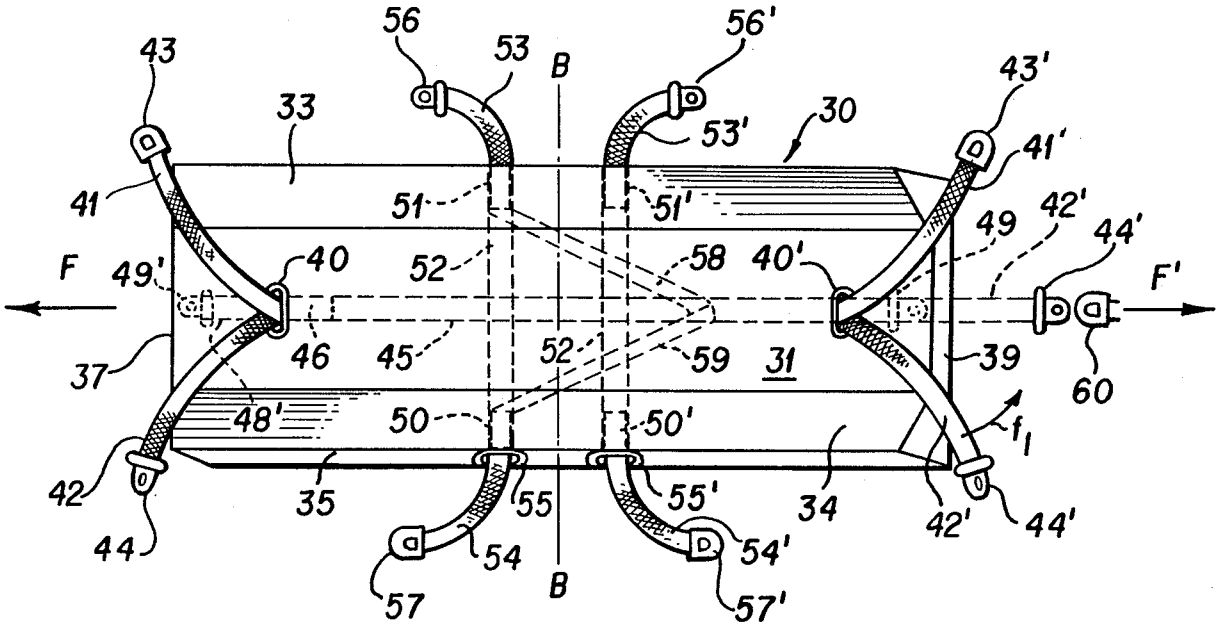
FIG. 5 is a top plan view of a variant of the stretcher mattress represented in FIGS. 2–4.

FIG. 5 shows a further embodiment which differs from that of FIG. 2 essentially in that mattress 30 is of laterally-reversed design with respect to the central transverse plane B—B, such that it is all the same whether the right or left end of mattress 30, as seen from FIG. 5, receives the head of the subject and is subsequently pointed in the direction of movement. The enumeration of the elements which are new as compared to FIG. 2 need not be gone into in detail here, since their reference numbers are the same as for FIG. 2, except for the fact that an apostrophe has been added. Only connecting belts 58 and 59 are, for clarity's sake, not shown for the belt system depicted in the right-hand area of FIG. 5. If the embodiment shown in FIG. 5 is employed in such a manner that the forward movement of the transport vehicle is in the direction of the arrow F, belts 53' and 54' can be used to provide additional support for the pelvis of the person being transported, in which case lock plate 56' is inserted into lock 57'. Similarly, belt bands 41' and 42' can be used to secure the legs of the subject if so desired. Alternatively, one of these belt bands—in the case shown, the one designated by reference number 42'—can be employed to arrest mattress 30 via lock plate 44' at a lock 60 which is located in a stationary fashion in the transport vehicle, as shown by dotted line in FIG. 5. The arrow f1 is to indicate that belt band 42' is moved towards the longitudinal center axis for this purpose. Of course, this embodiment also allows the mattress to be attached by means of belt bands 41' and 42' and the fixture elements attached to their ends, i.e., lock plate 44' and lock 43', to which end it is merely necessary to locate corresponding fixture elements on the stretcher frame and/or transport vehicle.

According to FIGS. 6–9, a bracing 70 is located on the underside of the mattress 30, said bracing consisting of two reinforcing elements 71,72 which are connected to one another by means of a hinge. Each of said reinforcing elements 71,72 comprises a board, for example, a plywood board appropriately attached to the mattress. In lieu of this, closed reinforcing frames formed of rectangular tubes or the like can also be disposed on the underside of the mattress. The division of the bracing is provided at a distance of approximately one third to one half of the length of the mattress from the head end 37.

Figure 8:
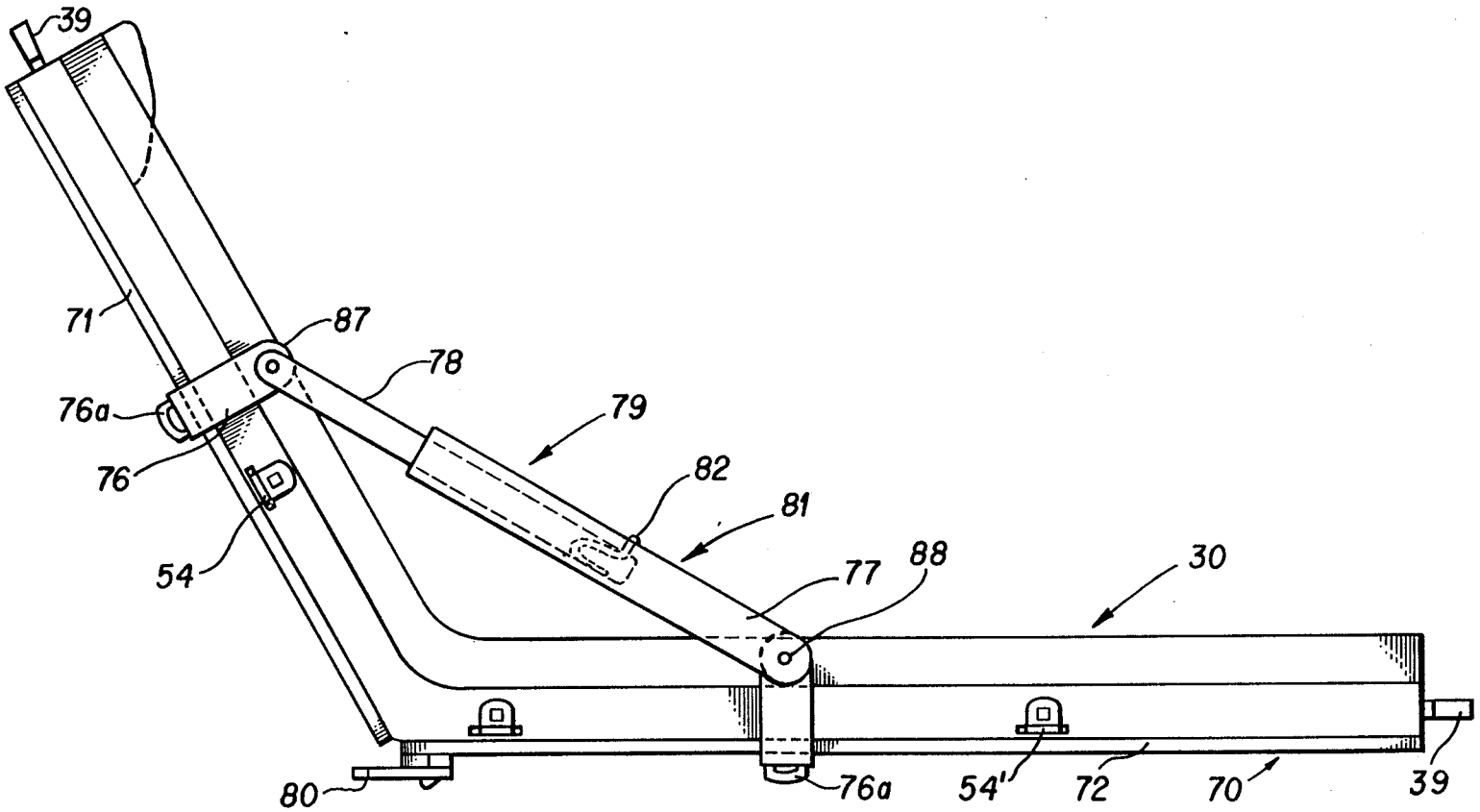
FIG. 8 is the mattress according to FIGS. 6 and 7 but partially folded to transport a subject in close quarters.

As seen especially from FIG. 8, reinforcing elements 71 and 72 are provided with shackles 76 on which a fixing device 79 is mounted, said fixing device consisting of two telescopic bars 77 and 78 which are adjustable relative to one another. Telescopic bars 77, 78, which are mounted about axes 87 and 88, can be fixed against one another by means of a known locking device 81 which can be released by means of a control knob 82. The lower portion **76*a* of the shackle 76 serves as a guiding means when sliding mattress 30 onto its stretcher frame 1. (See FIG. 9**.)

With mattress 30 and its bracing 70 bent as in FIG. 8, disabled or sick persons can be transported in close quarters without the mattress sagging in the middle in such a way as to bother the person being transported. Mattress 30 is gripped by its carrier loops 39 for this arrangement.

Figure 9:
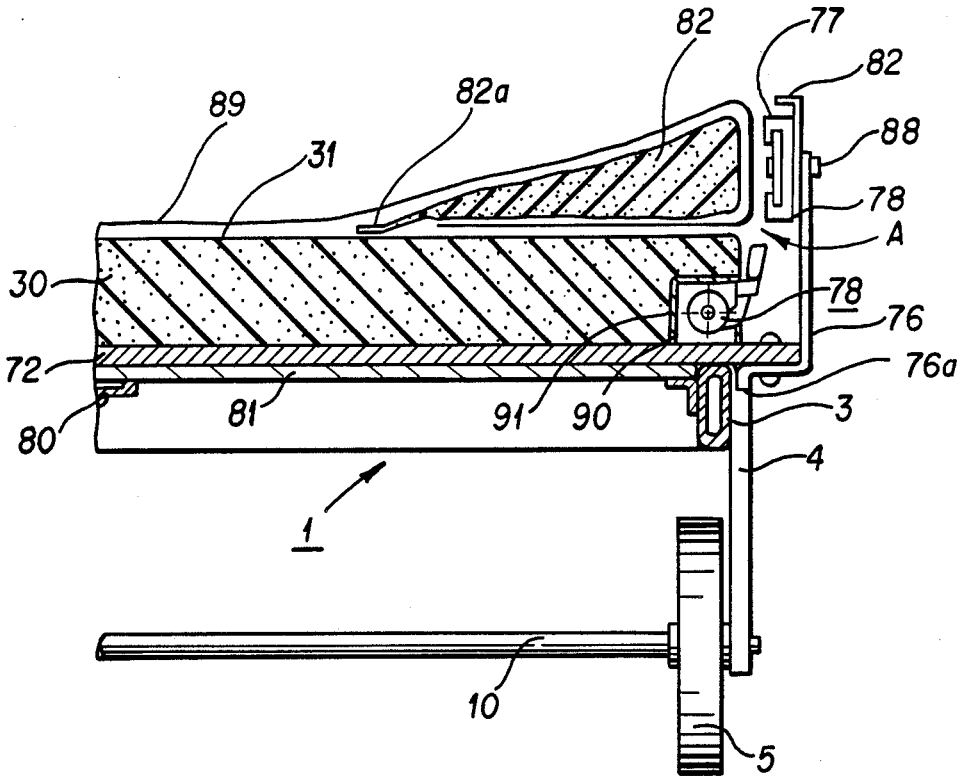
FIG. 9 is a section through the mattress according to FIGS. 6–8, along the line IX—IX in FIG. 7.

The second pair of belt bands 53, 54, 53', 54', which are located on stretcher frame 1 in the embodiments mentioned at the outset of the description, are disposed on the bracing 70 of mattress 30 in the present case, with the related self-arresting take-up devices 50, 51, 50', 51' being positioned beneath the mattress and attached to the bracing 70. An additional pelvic belt 77 is located approximately in the middle of mattress 30, for which there is provided another self-arresting take-up device 78 attached to the bracing 70 (FIG. 9). The housing 90 for receiving the take-up device 78 is located in a recess 91 of mattress 30.

Figure 6:
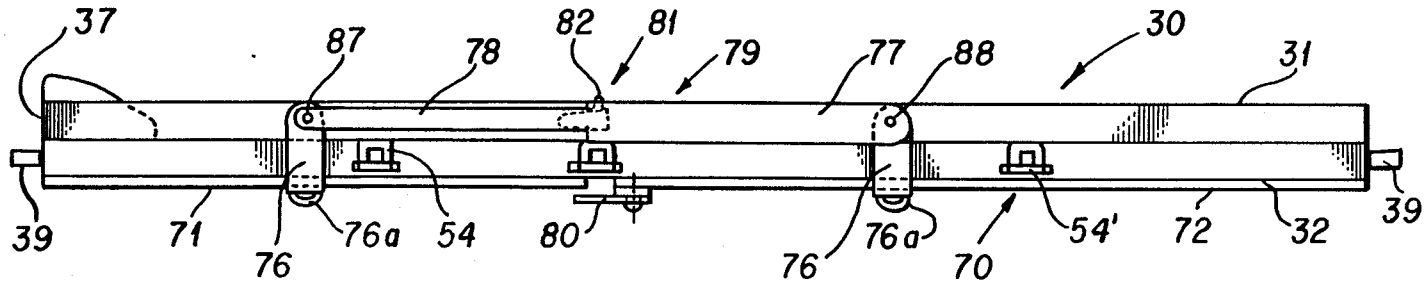
FIG. 6 is a side elevation of a mattress according to the invention and provided with a bracing.
Figure 7:
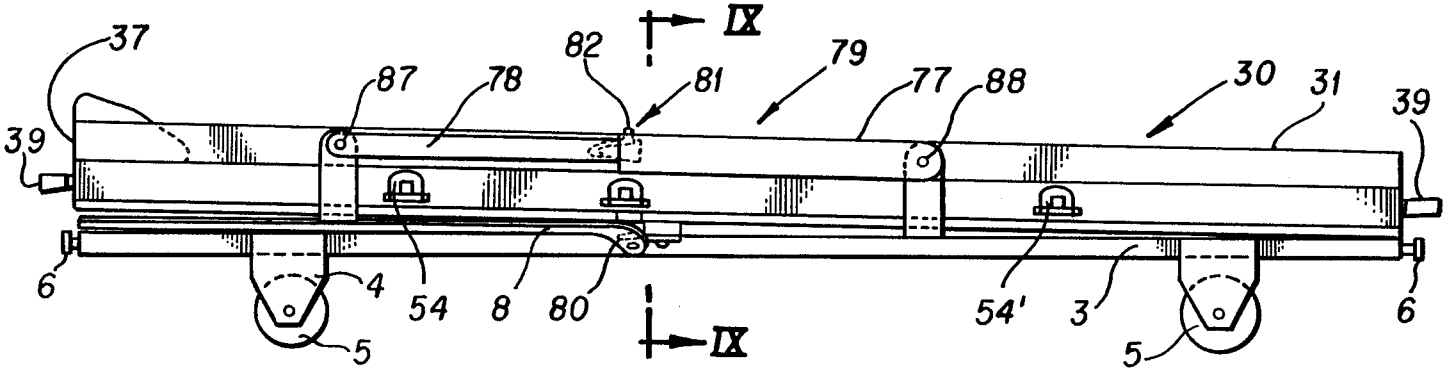
FIG. 7 is the mattress according to FIG. 6 after being placed on a stretcher frame.

As particularly evident from FIGS. 6, 8, and 9, a hook 80 is located on the underside of bracing 70, said hook being open in the direction of movement of the transport vehicle and, when the mattress is placed in transport position, engaging with a brace of the stretcher frame 1 formed by a rectangular tube 81. Belt band 45, which extends in the longitudinal direction of mattress 30 and is seen in FIGS. 2 to 5, is attached to the bracing 70, rendering it unnecessary to fasten a separate link, such as the link 49 provided for other embodiments, to the stretcher frame after the mattress has been slid onto said stretcher frame 1. Rather, the hook 80 automatically grips beneath the brace 81 of the stretcher frame 1 when the mattress is slid onto its carrier in the direction of movement F. The hook 80 could, of course, be provided with a corresponding counterpart on the transport vehicle itself.

As also evident from FIG. 9, wedge-shaped cushions 82 are fastened to the upper side 31 of mattress 30, forming a bolstered edge portion for said mattress 30. These cushions are attached to the mattress 30 only in the vicinity of their pointed edge 81*a*. The end of a sheet 89 laid across the mattress can be inserted under the cushions 82 in the direction of arrow A and held in place beneath said cushions. To this end it is not necessary to loosen or remove the belts located and/or fixed at the lower portion of the mattress.

Finally, it is also advantageous to provide on or in the mattress automatic take-up mechanisms for the belts of a belt system holding a disabled or sick person on the mattress. Said belt system can be of any kind and must not correspond to the restraint system according to the main claim of the present patent.

Figure 10:
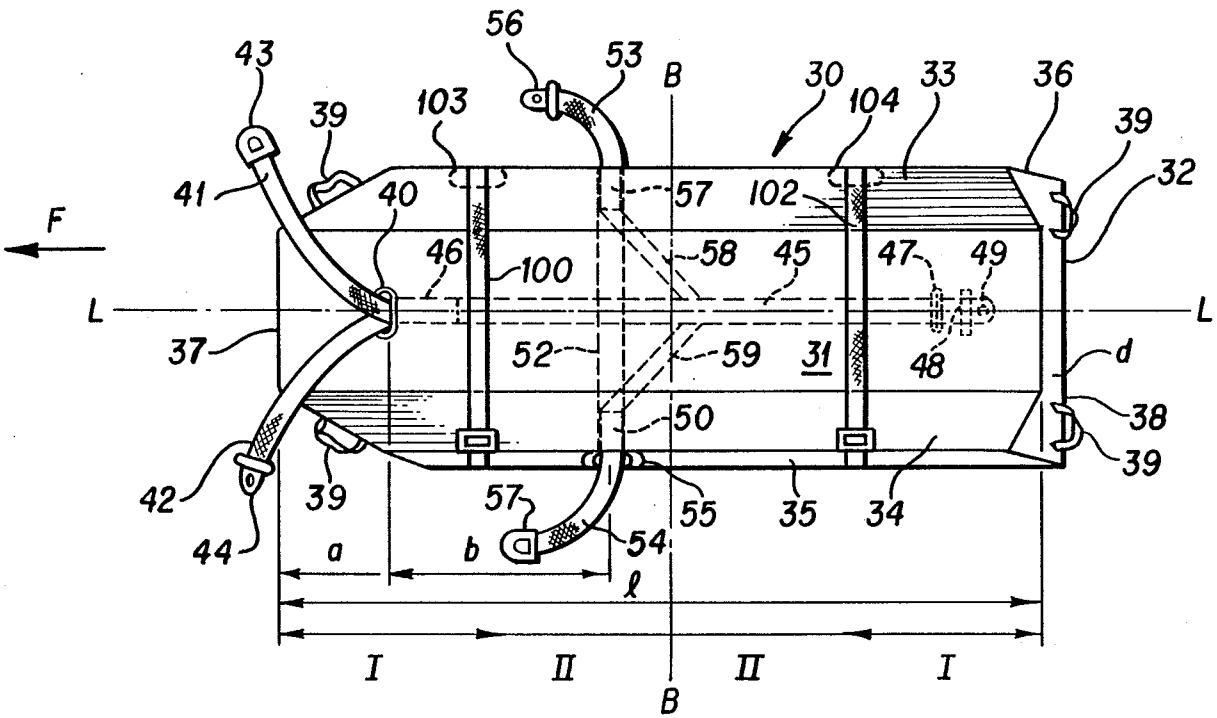
FIG. 10 is a top plan view of a further variant of the stretcher mattress represented in FIGS. 2–4.

The variant of the mattress represented in FIG. 10 corresponds to the mattress of FIG. 2 as regards the restraint system comprising the belts 42, 43, 53, 54, as well as the bolstered edge portions 33, 34 and further details. In addition thereto, a first belt system 102 is provided for securing the legs of a disabled or sick person and a second belt system 100 for securing the upper part of said person's body. Said belt systems 100 and 102 comprise belt take-up mechanisms 103 and 104, respectively, which are preferably self-arresting and provided on at least one side of said mattress beneath the edge portions 33,34. This variant will be adapted if the mattress is used with a stretcher not containing the fastening means described by the reference numbers 12 to 22, as the belt systems 100 and 102 take over the function of these fastening means.

Although particular structures have been described to illustrate various manners in which the device for carrying sick or disabled persons and in particular the stretcher mattress can be fabricated and utilized, it will be appreciated that the present invention is not limited to such particular illustrations and descriptions. Accordingly, any and all modifications and equivalent arrangements for such devices falling within the scope of the following claims should be considered to be part of the present invention.

I claim:

1. A stretcher mattress having an essentially planar upper side for supporting a disabled or sick person and an underside to be supported on a carrier, said mattress having a head end, a foot end, a central longitudinally axis extending therebetween and an opening in said upper side, said opening being spaced from said head end along said central longitudinal axis, a first pair of belt bands issuing from said opening, the free end of each one of said first pair of belt bands being connectable to a respective one of the free ends of a second pair of belt bands, one of said second pair of belt bands projecting from the left lateral edge area and the other from the right lateral edge area of said mattress at locations which are longitudinally displaced towards the middle of said mattress.

2. A stretcher mattress according to claim 1, wherein said second pair of belt bands issue from beneath said mattress.

3. A stretcher mattress according to claim 1, wherein said second pair of belt bands issue from the side wall of said mattress.

4. A stretcher mattress according to claim 2 or 3, wherein each of said second pair of belt bands are drawable from a take-up mechanism against the resistance of a spring.

5. A stretcher mattress according to claim 1, wherein said second pair of belt bands are drawable from a take-up mechanism similar to automatic safety belts, said take-up mechanism arresting the additional belt band in question if a given drawing speed is exceeded.

6. A stretcher mattress according to claim 1, wherein both of said second pair of belt bands are disposed symmetrically to the longitudinal center axis.

7. A stretcher mattress according to claim 1, further including means for releasably fastening the mattress to the carrier.

8. A stretcher mattress according to claim 1, wherein said second pair of belt bands are located at the side of a central transverse plane disposed towards the head end of the mattress, said plane passing perpendicularly through the center axis, said second pair of belt bands being spaced a distance of at least one fourth of the entire length of the stretcher mattress along the longitudinal center axis from said opening.

9. A stretcher mattress according to claim 1, wherein said opening is spaced a distance of not more than one fourth of the entire length of the mattress from said head end.

10. A stretcher mattress according to claim 9, wherein said distance comprises 10%–20% of the entire length of said mattress.

11. A stretcher mattress according to claim 1, wherein said opening is spaced a distance approximately 15% of the entire length of said mattress from said head end.

12. A stretcher mattress according to claim 1, wherein a belt lock is attached to the free end of one of said first pair and one of said second pair of belt bands and a lock plate is attached to the free end of the other of said first pair and the other of said second pair of belt bands.

13. A stretcher mattress according to claim 12, wherein each of the second pair of belt bands is drawable from a take-up mechanism against the resistance of a spring.

14. A stretcher mattress according to claim 12, wherein all belt locks are of identical design and all lock plates are of identical design.

15. A stretcher mattress according to claim 1, wherein said first pair of belt bands are connected to one end of at least one additional belt band extending beneath the mattress surface towards said foot end, fixing means at the distal end thereof with which said mattress is attachable to said carrier.

16. A stretcher mattress according to claim 15, wherein said mattress has a second opening in said underside near said foot end, said additional belt band passes through said mattress and issues from said second opening.

17. A stretcher mattress according to claim 7, further including a first belt lock element connected to the mattress, a second belt lock element connected to said carrier, and said first and second elements being operatively connectable to releasably attach said mattress to said carrier.

18. A stretcher mattress according to claim 1, wherein a third belt band releasably secures said mattress to said carrier, and said third belt band extends laterally over said mattress near said foot end.

19. A stretcher mattress according to claim 15, wherein said second pair of belt bands are connected to said additional belt band such that a force acting on said second belt bands in the longitudinal direction of said mattress is taken up by the fixing means of said mattress.

20. A stretcher mattress according to claim 1, wherein said mattress is flexible and at the same time possesses an inherent elastic rigidity.

21. A stretcher mattress according to claim 1, further including carrier handles disposed on the end areas of said mattress.

22. A stretcher mattress according to claim 1, wherein said mattress is provided with an upwardly projecting bolstered edge portion extending longitudinally on both sides of its upper side.

23. A stretcher mattress according to claim 1, wherein a transverse bracing means is provided in the area in which said second pair of belt bands project.

24. A stretcher mattress according to claim 1, further including an upwardly projecting bolstered edge portion extending longitudinally on each side of its upper side, each said bolstered edge portion being formed of a cushion whose cross-section is essentially outwardly ascending and wedge-shaped, said cushions being connected to said mattress only in the vicinity of their inner pointed edge.

25. A stretcher mattress according to claim 1, further including automatic arresting take-up devices, said devices being arranged in said mattress for said belt bands for securing a disabled or sick person on said mattress.

26. A stretcher mattress having an essentially planar upper side for supporting a disabled or sick person and an underside to be supported on a carrier, said mattress having a head end, a foot end, a central longitudinal axis extending therebetween, a peripheral edge extending around said upper side and an opening in said upper side, said opening being spaced from said head end along said longitudinal axis, a first pair of belt bands issuing from said opening, the free end of each one of said first pair of belt bands being connectable to a respective one of the free ends of a second pair of belt bands, one of said second pair of belt bands projecting from the left lateral edge area and the other from the right lateral edge area of said mattress at locations which are longitudinally displaced towards the middle of said mattress, and a pair of upwardly projecting bolstered edge portions extending longitudinally along said peripheral edge.

27. A stretcher mattress according to claim 26, wherein said mattress is flexible and at the same time possesses an inherent elastic rigidity.

28. A stretcher mattress according to claim 26, wherein a belt lock is fastened to the free end of one of said first pair of belt bands and one of said second pair of belt bands and a lock plate is fastened to the free end of the other first pair of belt bands and the other of said second pair of belt bands.

29. A stretcher mattress according to claim 26, wherein each of said second pair of belt bands is drawable from a take-up mechanism against the resistance of a spring and said take-up devices are located in said bolstered edge portions.

30. A stretcher mattress according to claim 26, wherein a transverse bracing means is provided in the area in which said second pair of belt bands laterally project.

31. A stretcher mattress according to claim 26, wherein said upwardly projecting edge portion is formed of a cushion whose cross-section is essentially outwardly ascending and wedge-shaped, said cushions being connected to said mattress only in the vicinity of their inner pointed edge.

32. A stretcher mattress according to claim 26, further including automatic arresting take-up devices, said devices being arranged in said mattress for said belt bands for securing a disabled or sick person on said mattress.

33. A stretcher mattress according to claim 26, further including a bracing being disposed on the underside of the mattress, said bracing consisting of two reinforcing elements connected to one another by hinges at a distance of a third to a half of the length of the mattress from the head end of said mattress and a fixing device being provided to fix the relative position of the two reinforcing elements.

34. A device for transporting disabled or sick persons, comprising a stretcher mattress with an essentially planar upper side for supporting a disabled or sick person and an underside to be supported on a carrier, said mattress having a head end, a foot end, a central longitudinal axis extending therebetweeen and an opening in said upper side, said opening being spaced from said head end along said central longitudinal axis, a first pair of belt bands issuing from said opening, one of said first pair of belt bands having a lock on the end thereof and the other of said belt bands having a lock plate on the end thereof, a second pair of belt bands, one of said second pair of belt bands issuing from one side and having a lock plate on the end thereof and the other of said second pair issuing from the other side of said mattress and having a lock on the end thereof, each of said first pair of belt bands being selectively connectable with either the other of said first pair of belt bands or the other of said second pair of belt bands.

35. A device for transporting disabled or sick persons according to claim 34, further including a bracing being disposed on the underside of the mattress, said bracing consisting of two reinforcing elements connected to one another by hinges at a distance of a third to a half of the length of the mattress from the head end of said mattress and a fixing device being provided to fix the relative position of the two reinforcing elements.

36. A device for transporting disabled or sick persons according to claim 34, wherein said mattress is flexible and at the same time possesses an inherent elastic rigidity.

37. A device for transporting disabled or sick persons according to claim 34, wherein carrier loops are located on the end areas of said mattress.

38. A device for transporting disabled or sick persons according to claim 34, wherein said mattress is provided with upwardly projecting bolstered edge cushions on both sides of its upper side, each of said bolstered edge cushions having a cross-section essentially outwardly ascending and wedge-shaped, said cushions being connected to said mattress only in the vicinity of their inner pointed edge.

39. A device for transporting disabled or sick persons according to claim 34, wherein automatic arresting take-up devices are disposed in the mattress for the belts of a belt system for securing a disabled or sick person on said mattress.

* * * * *